US007708532B2

(12) United States Patent
Ogawa et al.

(10) Patent No.: US 7,708,532 B2
(45) Date of Patent: May 4, 2010

(54) ELECTRIC COMPRESSOR

(75) Inventors: Nobuaki Ogawa, Shiga (JP); Masahiko Makino, Shiga (JP); Yukihiro Fujiwara, Shiga (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 1018 days.

(21) Appl. No.: 11/434,520

(22) Filed: May 16, 2006

(65) Prior Publication Data

US 2006/0275156 A1 Dec. 7, 2006

(30) Foreign Application Priority Data

May 19, 2005 (JP) ..... 2005-146259
May 9, 2006 (JP) ..... 2006-130481

(51) Int. Cl.
*F04B 17/00* (2006.01)
*F04B 35/04* (2006.01)

(52) U.S. Cl. ..... 417/410.5; 417/572; 418/55.6; 418/55.1

(58) Field of Classification Search ..... 417/410.5, 417/366, 572; 418/55.1, 55.2, 55.6
See application file for complete search history.

(56) References Cited

U.S. PATENT DOCUMENTS 4,929,160 A * 5/1990 Inoue ..... 418/55.2
5,304,045 A * 4/1994 Hoshino et al. ..... 417/372
5,531,577 A * 7/1996 Hayase et al. ..... 417/410.5
5,695,326 A * 12/1997 Oka et al. ..... 418/55.1
6,062,834 A * 5/2000 Masumoto et al. ..... 418/55.4
6,461,120 B2 * 10/2002 Harakawa et al. ..... 417/371
6,553,645 B2 * 4/2003 Nakamura et al. ..... 29/596
2004/0109772 A1 * 6/2004 Ogawa et al. ..... 417/410.5

FOREIGN PATENT DOCUMENTS

JP 2001-020865 1/2001

* cited by examiner

*Primary Examiner*—Devon C Kramer
*Assistant Examiner*—Peter J Bertheaud
(74) *Attorney, Agent, or Firm*—Kratz, Quintos & Hanson, LLP

(57) ABSTRACT

A lead wire of a motor is prevented from being damaged, and the reliability of an electric compressor is enhanced. The electric compressor 1 is provided with a division wall 80*b* which divides a discharge chamber 62 and a connection space 65 which connects a sealed terminal 90 and a lead wire 5*c* of a motor 5. With this configuration, it is possible to prevent discharge gas from directly flowing into the connection space 65, and to prevent the discharge gas from flowing into a wire passage 64 through which the lead wire 5*c* is passed. Therefore, vibration of lead wire 5*c* caused by gas pulse can be suppressed, the lead wire can be prevented from being damaged, and the reliability of the electric compressor can be enhanced.

5 Claims, 4 Drawing Sheets

ELECTRIC COMPRESSOR

TECHNICAL FIELD

The present invention relates to an electric compressor in which a compressing mechanism which sucks, compresses and discharge fluid and a motor which drives the compressing mechanism are accommodated in a container, and the motor is driven by a motor drive circuit.

BACKGROUND TECHNIQUE

In a conventional compressor of this kind, there is a conventional technique to lead out a lead wire of a motor toward a sealed terminal by cutting an outer periphery of a compressing mechanism to form a notch, and then, using a communication passage for refrigerant provided between the notch and a container as a wire passage for leading out a lead wire (e.g., see patent document 1).

FIG. 3 is a sectional view of a conventional vertical type electric compressor. FIG. 4 is a plan view of the electric compressor shown in FIG. 3.

In FIG. 3, compressed refrigerant discharged to a discharge chamber 103 from a discharge hole 102 of a compressing mechanism 101 passes through a descending communication passage 104 formed in the compressing mechanism 101 and enters into a lower motor space 105, passes through an ascending communication passage 107 provided between a hermetic container 106 and a notch formed by notching the compressing mechanism 101, enters into an upper sealed terminal-side space 108, and is discharged from a discharge tube 109.

In FIG. 4, a sealed terminal 110 and a motor 111 are electrically connected to each other through a lead wire 112 passing through the ascending communication passage 107. That is, the ascending communication passage 107 for refrigerant is also used as a wire passage.

[Patent Document 1] Japanese Patent Application Laid-open No. 2001-020865

SUMMARY OF THE INVENTION

According to the conventional structure, however, since the same member is used as both the wire passage of the lead wire and the communication passage for refrigerant, gas refrigerant discharged from the compressing mechanism flows around the lead wire, the lead wire is vibrated by pulsating flow, the vibrating lead wire rubs with a casting surface forming a notch of the compressing mechanism or an inner surface of the container, and there is an adverse possibility that the lead wire is damaged.

To prevent such a case, there are methods for protecting the lead wire using a tube, fixing the lead wire in a special manner, and improving the surface roughness of the notch by cutting the notch, but there is a problem that such methods increase the cost.

The present invention has been accomplished to solve the conventional problems, and it is an object of the invention to provide an electric compressor in which a lead wire leading-out connection of a motor and a communication passage for refrigerant are separated from each other, thereby preventing the lead wire from being damaged and enhancing the reliability.

According to the electric compressor of the present invention, it is possible to prevent a lead wire of a motor from being damaged, and to enhance the reliability.

DISCLOSURE OF THE INVENTION

A first aspect of the present invention provides an electric compressor in which a motor and a compressing mechanism are accommodated in a container, the compressing mechanism is connected to the motor through a drive shaft, the container is divided into a first space and a second space by the compressing mechanism, and the motor is disposed in the first space, wherein the second space is divided into a discharge chamber and a connection space by a division wall, a discharge hole of the compressing mechanism is in communication with the discharge chamber, a sealed terminal is disposed in the connection space, a wire passage for bringing the first space and the connection space into communication with each other is formed in an outer periphery of the compressing mechanism, and a lead wire for connecting the motor and the sealed terminal with each other is disposed in the wire passage. With this aspect, vibration of the lead wire caused by gas pulse can be suppressed, the lead wire is prevented from being damaged, and the reliability of the electric compressor can be enhanced.

According to a second aspect of the invention, in the electric compressor of the first aspect, a discharge port which is in communication with the first space is formed, and a communication passage for bringing the first space and the discharge chamber into communication with each other is formed in an outer periphery of the compressing mechanism. With this aspect, refrigerant discharged into the discharge chamber is introduced to the peripheries of the motor by the communication passage, the refrigerant is allowed to flow out from the container through the discharge port, and the lubricating oil can be separated from the refrigerant. Thus, it is possible to prevent the lubricating oil from flowing out from the container.

According to a third aspect of the invention, in the electric compressor of the first aspect, the division wall and the container are integrally formed together. With this aspect, the structure is simplified, and the cost can be reduced.

According to a fourth aspect of the invention, in the electric compressor of the first aspect, the drive shaft is used in a horizontal direction, and the connection space and the wire passage are formed at positions higher than an oil level of lubricating oil stored in the container. With this aspect, it is possible to prevent lubricating oil from flowing into the connection between the sealed terminal and the lead wire, and to prevent the insulation resistance from being lowered.

According to a fifth aspect of the invention, in the electric compressor of the fourth aspect, the connection space and the wire passage are formed at positions higher than rotation centers of the motor and the compressing mechanism. With this aspect, especially when the compressor is operated at low speed at which the lubricating oil is prone to stay, the oil level does not reach the wire passage and the connection space. With this structure, deterioration in reliability of the electric compressor caused by deterioration of insulation resistance can be prevented.

According to a sixth aspect of the invention, in the electric compressor of the fourth aspect, the division wall is inclined, and the wire passage is formed at position lower than the sealed terminal. With this aspect, even when lubricating oil in a mist-state enters the connection space, the lubricating oil flows out from the wire passage and thus, the lubricating oil does not stay in the connection space. With this, the deterioration of the insulation resistance can be prevented.

A seventh aspect of the invention provides an electric compressor in which a motor and a compressing mechanism are accommodated in a container, the compressing mechanism is connected to the motor through a drive shaft, the container is divided into a first space and a second space by the compressing mechanism, the motor is disposed in the first space, a discharge port which is in communication with the first space is formed and, a communication passage for bringing the first space and a discharge chamber into communication with each other is formed in an outer periphery of the compressing mechanism, wherein the second space is divided into the discharge chamber and a connection space by a division wall, a discharge hole of the compressing mechanism is in communication with the discharge chamber, a sealed terminal is disposed in the connection space, a wire passage for bringing the first space and the connection space into communication with each other is formed in an outer periphery of the compressing mechanism, and a lead wire for connecting the motor and the sealed terminal with each other is disposed in the wire passage. With this aspect, the wire passage of the compressing mechanism through which the lead wire is passed is separated from the communication passage for refrigerant, vibration of the lead wire caused by gas pulse can be suppressed, the lead wire is prevented from being damaged, and the reliability of the electric compressor can be enhanced.

PREFERRED EMBODIMENT OF THE INVENTION

An embodiment of the present invention will be explained with reference to FIGS. 1 and 2. The invention is not limited to the embodiment.

Figure 1:
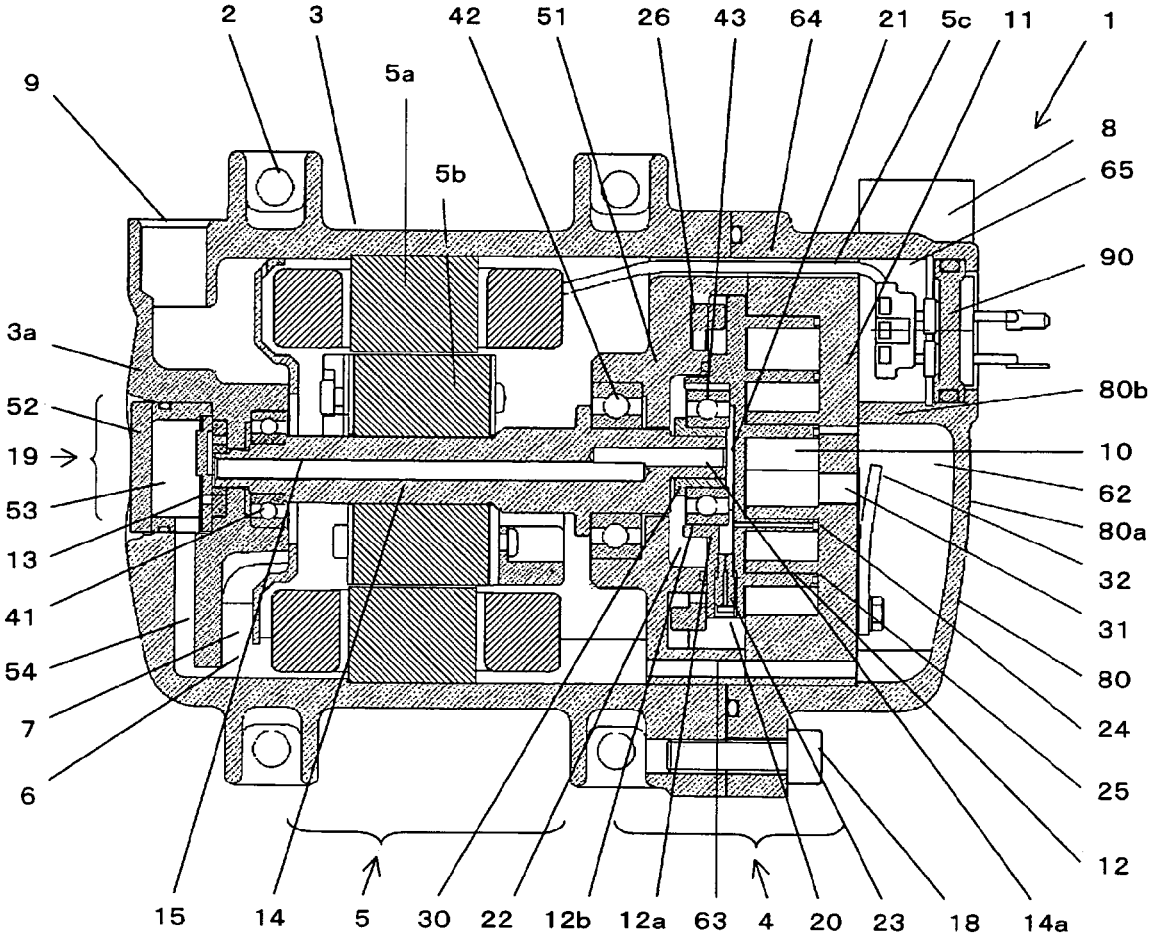
FIG. 1 is a sectional view of an electric compressor of a first embodiment of the present invention.

FIG. 1 is a sectional view of an electric compressor of a first embodiment of the present invention. FIG. 2 is a side view of the electric compressor shown in FIG. 1.

The electric compressor of the embodiment shown in FIGS. 1 and 2 will be explained below.

The electric compressor 1 includes a container comprising a main container 3 and an auxiliary container 80, a compressing mechanism 4 which sucks, compresses and discharges working fluid, a motor 5 which drives a compressing mechanism 4, a liquid reservoir 6 accommodating therein lubricating oil 7 for lubricating sliding portions including the compressing mechanism 4, an oil supply device 19 and a sealed terminal 90.

The compressing mechanism 4 and the motor 5 are accommodated in the container. The compressing mechanism 4 and the motor 5 are connected to each other through a drive shaft 14. The container is divided into a first space and a second space by the compressing mechanism 4. The motor 5 is disposed in the first space.

The second space is located in the compressing mechanism 4 on the opposite side from the motor 5. The second space is divided into a discharge chamber 62 and a connection space 65 by a division wall 80*b* which is integrally formed with the auxiliary container 80. A discharge hole 31 of the compressing mechanism 4 is in communication with the discharge chamber 62, and the sealed terminal 90 is disposed in the connection space 65. A wire passage 63 which brings the first space and the connection space 65 into communication with each other is formed in an outer periphery of the compressing mechanism 4. A lead wire 5*c* which connects the motor 5 and the sealed terminal 90 with each other is formed in a wire passage 64.

That is, in this embodiment, the second space is located in the compressing mechanism 4 on the opposite side from the motor 5, and is occupied by discharged gas. The second space is divided by the division wall 80*b* into the discharge chamber 62 and the connection space 65 in which the sealed terminal 90 and the lead wire 5*c* are connected to each other.

The main container 3 is formed with a discharge port 9 which is in communication with the first space. A communication passage 63 which brings the first space and the discharge chamber 62 into communication with each other is formed in an outer periphery of the compressing mechanism 4.

In the embodiment, as the electric compressor 1, a horizontal type compressor which is set up horizontally using mounting legs 2 located around a body of the electric compressor 1 is used. A scroll type compressing mechanism is used as the compressing mechanism 4. The motor 5 is driven by a motor drive circuit (not shown). Working fluid which is used in the embodiment is a refrigerant. Lubricating oil 7 is used for lubricating sliding portions and for sealing the sliding portions of the compressing mechanism 4. The lubricating oil 7 has compatibleness with respect to the refrigerant.

A positive-displacement pump 13, an auxiliary bearing 41, the motor 5 and a main bearing member 51 having a main bearing 42 are disposed in the main container 3 from the side of one end wall 3*a* in the axial direction.

A lid body 52 is fitted to the positive-displacement pump 13 from an outer surface of the end wall 3*a*. A pump chamber 53 is formed between the lid body 52 and the end wall 3*a*. The pump chamber 53 is in communication with the liquid reservoir 6 through a suction passage 54.

The auxiliary bearing 41 is supported by the end wall 3*a*. The end wall 3*a* is pivotally supports the drive shaft 14 on a side connected to the positive-displacement pump 13 through the auxiliary bearing 41.

The motor 5 rotates the drive shaft 14 by a stator 5*a* which is fixed to an inner periphery of the main container 3 by shrink fit and by a rotor 5*b* fixed to the drive shaft 14.

An eccentric shaft 14*a* is integrally formed on an end surface of the drive shaft 14 on the side of the compressing mechanism 4. A bush 30 is fitted over the eccentric shaft 14*a*. The bush 30 makes it possible to smoothly turn an orbiting scroll 12 which is opposed to a fixed scroll 11 through an eccentric bearing 43.

A cylindrical portion 12*b* projects from a back surface of an orbiting scroll end plate 12*a* of the orbiting scroll 12. An eccentric bearing 43 is accommodated in the cylindrical portion 12*b*. In inner ring of the eccentric bearing 43 is fitted over the bush 30, and an outer ring of the eccentric bearing 43 is fitted to into the cylindrical portion 12*b*.

The fixed scroll 11 is provided with a suction hole (not shown). A valve device (not shown) is provided for interrupting the communication between the suction hole and the back pressure chamber 20.

The main bearing member 51 is fixed to an inner periphery of the auxiliary container 80 through a bolt (not shown) or the like, and the main bearing member 51 pivotally supports the drive shaft 14 on the side of the compressing mechanism 4 through the main bearing 42. An outer peripheral surface of the fixed scroll 11 is mounted on an outer peripheral surface of the main bearing member 51, the orbiting scroll 12 is sandwiched between the main bearing member 51 and the fixed scroll 11, and an Oldham ring 26 which prevents the orbiting scroll 12 from rotating and turns the orbiting scroll 12 is provided between the main bearing member 51 and the orbiting scroll 12. With this, the compressing mechanism 4 is configured.

A portion (e.g., the main bearing member 51) of the compressing mechanism 4 which protrudes and is exposed from the auxiliary container 80 is covered with the main container 3 by fixing the main container 3 and the auxiliary container 80 to each other through a bolt 18 such that openings of the main container 3 and the auxiliary container 80 butts against each other. With this, the end wall 3*a* of the main container 3 is formed on the auxiliary container 80 on the opposite side from an end wall 80*a* in the axial direction.

The compressing mechanism 4 is located between a suction port 8 provided in the auxiliary container 80 and a discharge port 9 formed in the main container 3. A suction hole (not shown) formed in the fixed scroll 11 of the compressing mechanism 4 is in direct communication with the suction port 8.

The discharge hole 31 is opened at the discharge chamber 62 formed in the auxiliary container 80 through a reed valve 32.

The discharge chamber 62 is in communication with the first space located between the compressing mechanism 4 and the end wall 3*a*, that is, located on the side of the motor 5 which is in communication with the discharge port 9, through the communication passage 63 formed between the main container 3 and the fixed scroll 11, and between the main container 3 and the main bearing member 51. The communication passage 63 may be formed so as to penetrate through the fixed scroll 11 and the main bearing member 51.

The lead wire 5*c* of the motor 5 is led out through the wire passage 64 formed between the main container 3 and the fixed scroll 11, and between the main container 3 and the main bearing member 51. The lead wire 5*c* is connected to the sealed terminal 90 which penetrates the auxiliary container 80. The sealed terminal 90 is connected to a drive circuit. The wire passage 64 may be formed so as to penetrate through the fixed scroll 11 and the main bearing member 51.

Next, the operation of the electric compressor of the embodiment will be explained.

When the orbiting scroll 12 is turned with respect to the fixed scroll 11 by the drive shaft 14 of the motor 5, a compression space 10 formed by meshing the fixed scroll 11 and the orbiting scroll 12 of the compressing mechanism 4 with each other is varied in capacity and moved. With this capacity variation, refrigerant returning from an external cycle is introduced into the suction hole of the fixed scroll 11 from the suction port 8 of the auxiliary container 80, and is sucked into the compression space 10. The sucked refrigerant is compressed in the compression space 10 and is discharged into the discharge chamber 62 from the discharge hole 31.

Refrigerant discharged into the discharge chamber 62 enters the first space on the side of the motor 5 from the second space on the opposite side from the motor 5 through the communication passage 63, the refrigerant cools the motor 5 and flows out into the external cycle through the discharge port 9 of the main container 3. In the suction, compression and discharge processes, the refrigerant separates the lubricating oil 7 by gas/liquid separation effect of collision or choke, and a portion of the lubricating oil 7 attached to the refrigerant lubricates the auxiliary bearing 41.

On the other hand, lubricating oil 7 stored in the liquid reservoir 6 of the main container 3 is supplied by the positive-displacement pump 13 driven by the drive shaft 14 to a liquid reservoir 21 formed in a back surface of the orbiting scroll 12 through an oil supply passage 15 of the drive shaft 14. The lubricating oil 7 can be supplied utilizing a pressure difference in the main container 3.

A portion of the lubricating oil 7 supplied to the liquid reservoir 21 passes through the back surface of the orbiting scroll end plate 12*a*, is limited to a predetermined pressure by a drawing 23 (pressure reducing means), and is supplied to the back pressure chamber 20 located on a surface opposite from a lap of the outer periphery of the orbiting scroll 12. The back pressure in the back pressure chamber 20 is adjusted to a predetermined value by a valve device provided in the fixed scroll 11, the orbiting scroll 12 is pressed by this predetermined pressure, and the lubricating oil 7 is led to the compression space 10, thereby sealing and lubricating between the fixed scroll 11 and the orbiting scroll 12.

The lubricating oil 7 is supplied to a tip end of a scroll lap of the orbiting scroll 12 through the interior of the orbiting scroll 12. That is, the lubricating oil 7 is supplied to a holding groove 25 which holds a chip seal 24 which seals between the fixed scroll 11 and the orbiting scroll 12, thereby sealing and lubricating between the fixed scroll 11 and the orbiting scroll 12.

Another portion of the lubricating oil 7 supplied to the liquid reservoir 21 lubricates the main bearing 42 and the eccentric bearing 43 through the eccentric bearing 43, the liquid reservoir 22 and the main bearing 42, and then, the lubricating oil 7 flows out into the first space on the side of the motor 5 and is collected into the liquid reservoir 6.

According to the configuration, the electric compressor of the embodiment can prevent gas discharged from the compressing mechanism 4 from directly flowing into the connection space 65 connecting the sealed terminal 90 and the lead wire 5*c* of the motor 5. That is, the discharged gas fills the wire passage 64 through which the lead wire 5*c* is passed, but does not flow into the wire passage 64.

In other words, the wire passage 64 of the compressing mechanism 4 through which the lead wire 5*c* passes can be separated from the refrigerant communication passage 63.

With the above effect, vibration of lead wire 5*c* caused by gas pulse can be suppressed, the lead wire can be prevented from being damaged and the reliability can be enhanced.

As a result, it is possible to eliminate unnecessary expensive operations such as operation for protecting the lead wire 5*c* using a tube, operation for fixing the lead wire 5*c*, and operation for cutting the casting surface of the wire passage 64 to enhance the surface roughness.

According to the electric compressor of the embodiment, the discharge port 9 which is in communication with the first space is formed, and a communication passage 63 which brings the first space and the discharge chamber 62 into communication with each other is formed in the outer periphery of the compressing mechanism 4. With this configuration, refrigerant discharged into the discharge chamber 62 can be introduced to the peripheries of the motor 5 by the communication passage 63, and is allowed to flow out from the main container 3 through the discharge port 9. Therefore, the lubricating oil 7 can be separated from the refrigerant so that the lubricating oil 7 is prevented from flowing out from the main container 3.

According to the electric compressor of the embodiment, since the division wall 80*b* and the auxiliary container 80 are integrally formed together, the structure is simple, and the cost of the electric compressor can be reduced.

According to the electric compressor of the embodiment in which the drive shaft 14 is used in the horizontal direction, the connection space 65 and the wire passage 64 are formed higher than the oil level of the lubricating oil 7 stored in the main container 3. With this structure, it is possible to prevent the lubricating oil 7 from flowing into the connection space 65 connecting the sealed terminal 90 and the lead wire 5*c*, and to prevent the insulation resistance from being deteriorated by the lubricating oil 7.

Figure 2:
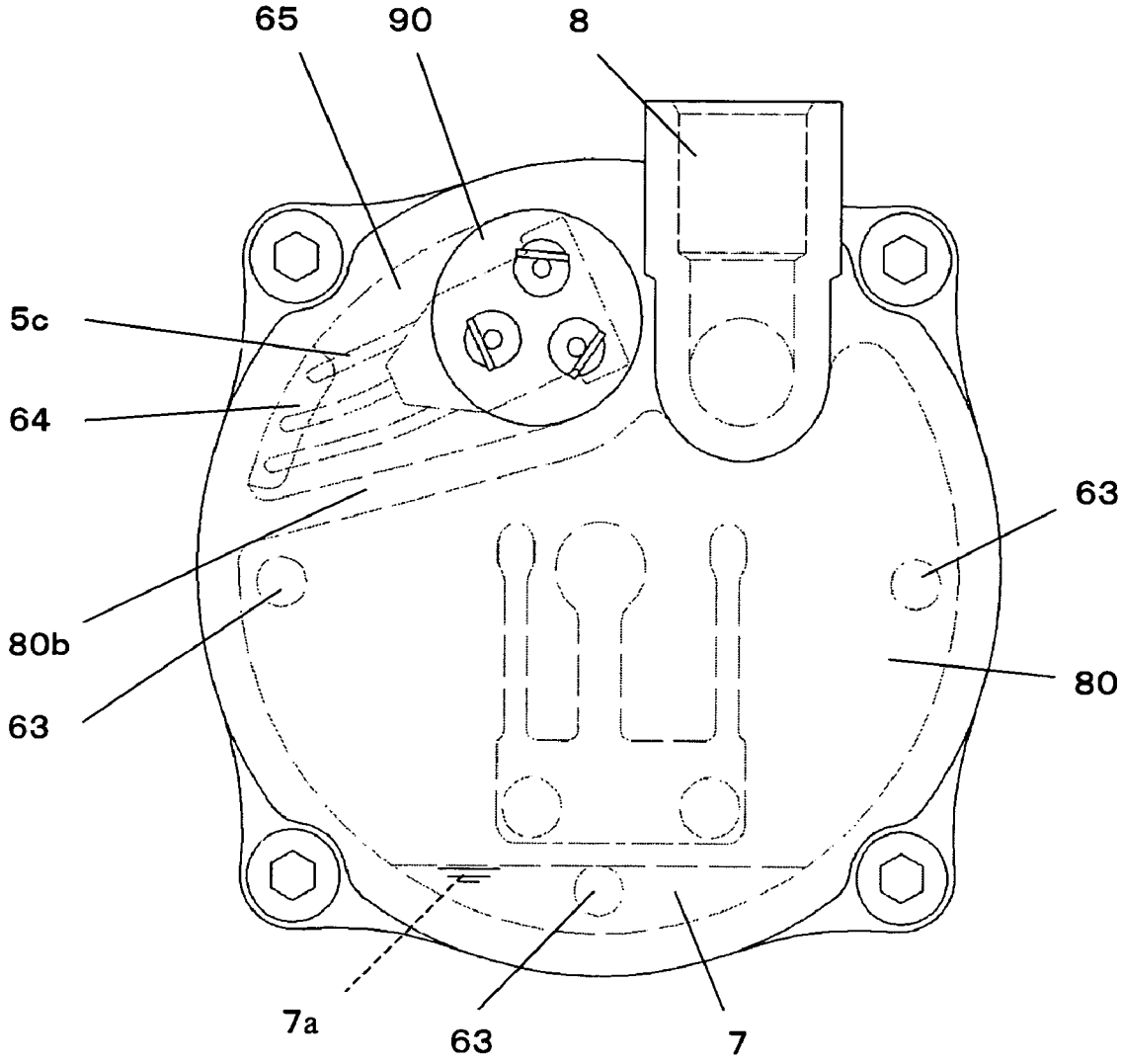
FIG. 2 is a side view of the electric compressor shown in FIG. 1.
Figure 3:
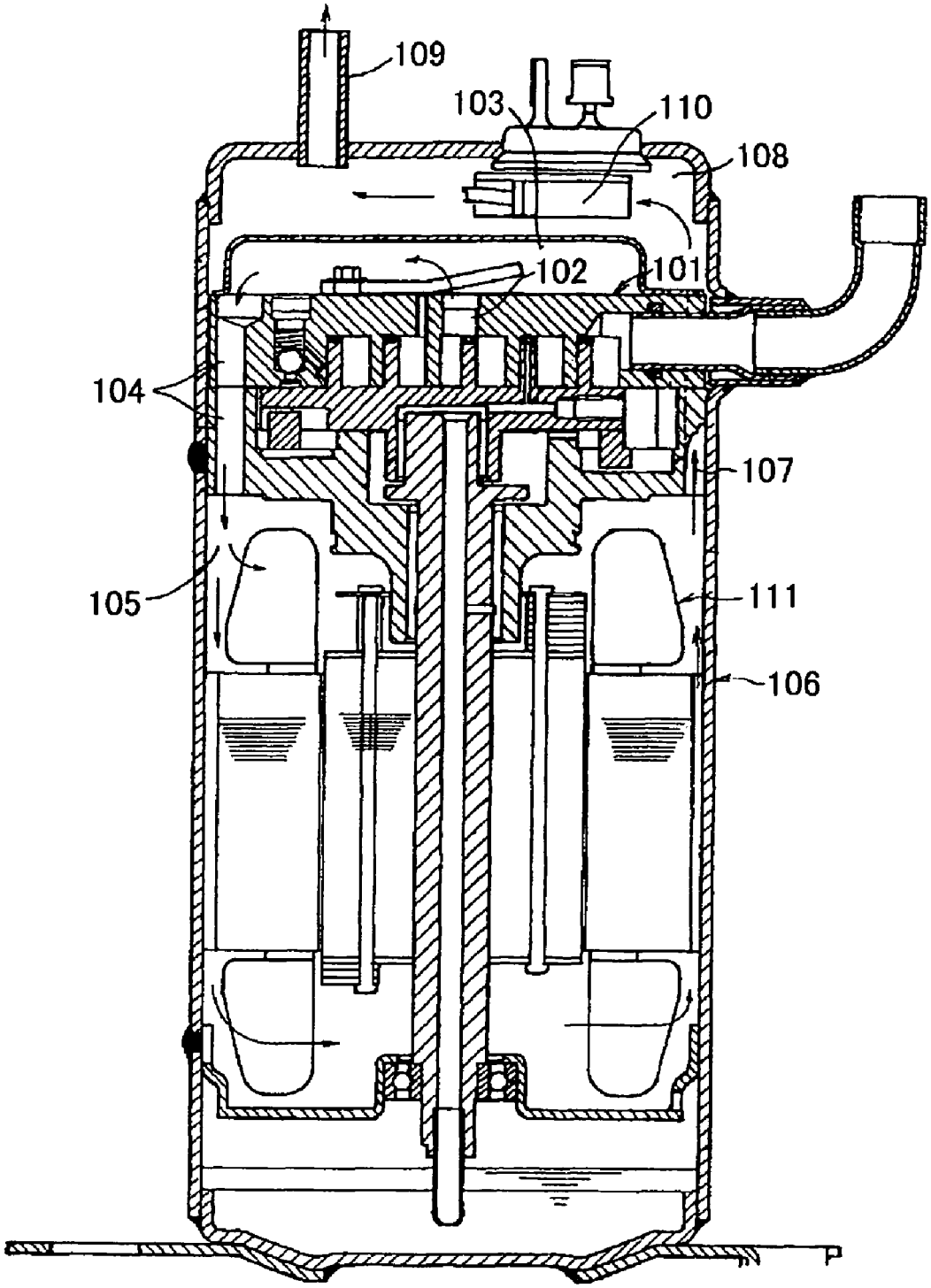
FIG. 3 is a sectional view of a conventional vertical type electric compressor.
Figure 4:
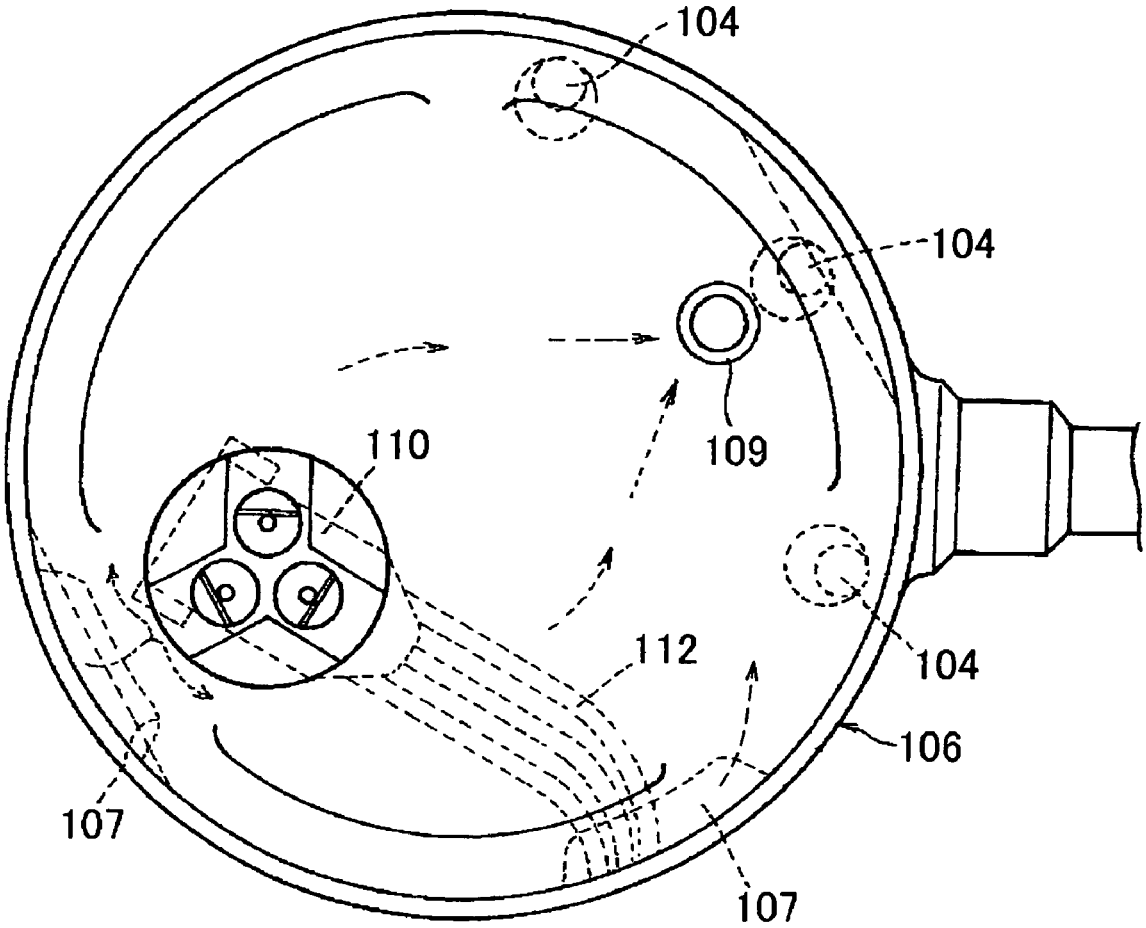
FIG. 4 is a plan view of the electric compressor shown in FIG. 3.

According to the electric compressor of the embodiment, as shown in FIG. 2, the connection space 65 and the wire passage 64 are formed above the oil level of the lubricating oil 7, and are formed above the rotation centers of the motor 5 and the compressing mechanism 4. With this configuration, especially when the compressor is operated at low speed at which the lubricating oil 7 is prone to stay, even though the oil level rises and the lubricating oil 7 is stirred by the rotor 5*b* of the motor 5, the lubricating oil 7 does not reach the wire passage 64 and the connection space 65. With this structure, deterioration in reliability of the electric compressor caused by deterioration of insulation resistance can be prevented.

According to the electric compressor of the embodiment, as shown in FIG. 2, the division wall 80*b* is inclined in the horizontal direction or downward toward the outer periphery, and the wire passage 64 is formed at a position including the lowermost portion of the connection space 65, e.g., at a location lower than the sealed terminal 90. With this configuration, even though lubricating oil 7 in a mist-state enters the connection space 65, the lubricating oil 7 flows out from the inclined wire passage 64 and thus, the lubricating oil 7 does not stay in the connection space 65. With this, the deterioration of the insulation resistance caused by the lubricating oil 7 can be prevented, and it is possible to provide a reliable electric compressor.

The electric compressor of the present invention can prevent a lead wire of a motor from being damaged, can enhance the reliability, and can be applied to an electric compressor which accommodates a compressing mechanism which sucks, compresses and discharges fluid, and the motor which drives the compressing mechanism in a container, and in which the motor is driven by a motor drive circuit.

What is claimed is:

1. An electric compressor in which a motor and a compressing mechanism are accommodated in a container, said compressing mechanism is connected to said motor through a drive shaft, said container is divided into a first space and a second space by said compressing mechanism, said motor is disposed in said first space, a discharge port which is in communication with said first space is formed, and a communication passage for bringing said first space and a discharge chamber into communication with each other is formed in an outer periphery of said compressing mechanism, wherein said second space is divided into said discharge chamber and a connection space by a division wall which prevents communication of the discharge chamber with the connection space, a discharge hole of said compressing mechanism is in communication with said discharge chamber, a sealed terminal is disposed in said connection space, a wire passage for bringing said first space and said connection space into communication with each other is formed in an outer periphery of said compressing mechanism, and a lead wire for connecting said motor and said sealed terminal with each other is disposed in said wire passage.

2. The electric compressor according to claim 1, wherein said division wall and said container are integrally formed together.

3. The electric compressor according to claim 1, wherein said drive shaft is used in a horizontal direction, and said connection space and said wire passage are formed at positions higher than an oil level of lubricating oil stored in said container.

4. The electric compressor according to claim 3, wherein said connection space and said wire passage are formed at positions higher than rotation centers of said motor and said compressing mechanism.

5. The electric compressor according to claim 3, wherein said division wall is inclined, and said wire passage is formed at position lower than said sealed terminal.

* * * * *